US008413834B2

(12) United States Patent
Oberholzer

(10) Patent No.: US 8,413,834 B2
(45) Date of Patent: Apr. 9, 2013

(54) CONTAINER WITH A TEAR-OFF LID AND METHOD FOR ITS PRODUCTION

(75) Inventor: Marcel Oberholzer, Kindhausen (CH)

(73) Assignee: Soudronic AG, Bergdietikon (CH)

( * ) Notice: Subject to any disclaimer, the term of this patent is extended or adjusted under 35 U.S.C. 154(b) by 1517 days.

(21) Appl. No.: 11/863,676

(22) Filed: Sep. 28, 2007

(65) Prior Publication Data

US 2008/0078766 A1 Apr. 3, 2008

(30) Foreign Application Priority Data

Sep. 29, 2006 (CH) ..... 1552/06

(51) Int. Cl.

| | |
|---|---|
| ***B65D 6/30*** | (2006.01) |
| ***B65D 8/20*** | (2006.01) |
| ***B65D 17/34*** | (2006.01) |
| ***B65D 41/00*** | (2006.01) |

(52) U.S. Cl. ..... 220/619; 220/254.1; 220/359.1; 220/270; 413/4

(58) Field of Classification Search ..... 220/254.1, 220/359.1, 359.2, 610, 614, 619, 699, 700, 220/701, 270, 359.4; 215/232; 229/123.1; 413/2, 4, 8, 56

See application file for complete search history.

(56) References Cited

U.S. PATENT DOCUMENTS

| | | | | |
|---|---|---|---|---|
| 3,142,412 A | | 7/1964 | Blakeslee | |
| 3,263,636 A | | 8/1966 | Smith | |
| 3,525,455 A | * | 8/1970 | Saunders | 220/619 |
| 4,010,703 A | * | 3/1977 | Spiekermann et al. | 413/21 |
| 4,915,254 A | * | 4/1990 | Zumsteg | 220/359.2 |
| 5,242,254 A | * | 9/1993 | Harold | 413/21 |
| 5,445,291 A | | 8/1995 | Daniel | |
| 6,036,043 A | * | 3/2000 | Erfgen et al. | 220/270 |
| 7,055,713 B2 | * | 6/2006 | Rea et al. | 220/276 |

FOREIGN PATENT DOCUMENTS

| | | |
|---|---|---|
| CA | 962205 | 2/1975 |
| EP | 0 090 957 A2 | 10/1983 |
| FR | 2144660 | 2/1973 |
| GB | 2157644 A | 10/1985 |
| WO | 2005105596 A1 | 11/2005 |
| WO | 2006/092073 A1 | 9/2006 |

OTHER PUBLICATIONS

European Search Report for EP 07018875, Document dated Dec. 10, 2007.

* cited by examiner

*Primary Examiner* — Anthony Stashick
*Assistant Examiner* — James N Smalley
(74) *Attorney, Agent, or Firm* — McCormick, Paulding & Huber LLP

(57) ABSTRACT

A container (1) is provided with a tear-off lid (2) having a take out opening covered by a tear-off foil (25). The cut edge (3) of the take out opening is bent back into the chuck wall (34) area. By this the bare cut edge is protected by the connection of lid and container body. This connection can be provided by a seaming connection.

12 Claims, 3 Drawing Sheets

CONTAINER WITH A TEAR-OFF LID AND METHOD FOR ITS PRODUCTION

CROSS REFERENCE TO RELATED APPLICATIONS

This application claims the priority of Swiss patent application No. 1552/06, filed on Sep. 29, 2006, the disclosure of which is incorporated herein by reference in its entirety.

BACKGROUND

The invention relates to a container having a tear-off lid. The lid has a lid ring which provides the take out opening covered by a tear-off foil. Lid ring and tear-off foil are connected to each other by a hot sealable plastic coating in a connection area around the edge of the take out opening and the tear-off foil can be torn away to open the container so that its contents can be accessed through the take out opening of the lid. Further the invention relates to a lid with a tear-off foil and to a lid ring for such containers. Still further the invention relates to a method for the manufacture of a tear-off lid. In this context the invention relates to the protection of the bare metal edge that results from punching or cutting of the lid sheet metal blank for providing the take out opening.

PRIOR ART

It is known to provide lids on containers, for example on cans or boxes, respectively, as ring shaped lids, in particular metal lids, being permanently fixed to the container and being provided with a take out opening in said lid which is closed by a tear-off foil, and in particular a tear-off metal foil or composite material foil, respectively, fixed to the ring shaped lid by hot sealing up to the first use of the contents of the package. Such lids are known as tear-off lids. An additional plastic cover that is arranged over the metal lid provides a closure for the package during the consumption time of the contents of the package when the tear-off foil has been removed. FIGS. 1 to 8 show such a container and explain the manufacturing steps for making such prior art lids.

Known apparatus for making metal lids with tear-off foils are usually provided with several working stations arranged on a machine frame in a linear or circular manner and are provided with a conveying device which conveys the lids from the input side of the apparatus, where preformed lid parts enter the apparatus, to the end of the apparatus where the finished lids leave the apparatus. FIG. 2 shows stapled metal blanks 20 as an example for such lid parts. Only a sector of each disk-shaped blank is shown in FIG. 2 and as well in the following Figures to simplify the drawings. These blanks are for example round metal disks. As an example their diameter is 11 centimeters. Other basic shapes are of course possible, such as square or rectangular shapes. Of course other diameters can be selected. The blanks have already been preformed at their edges as shown in FIG. 2 by means of another machine. This shape of the outer border of the lid is later used for fixing the lid to the container body by hemming. In a first working station of the lid manufacturing apparatus the blanks are worked upon with an upper and a lower die to punch an opening 26 (which later will provide the take out opening of the lid) into the disk, as can be seen in FIG. 3 in which the cut edge of the opening is referenced as 21 and the punched out round plate is shown as 27. In the next working step the edge 21 is drawn downwardly resulting in the shape 22 of the edge of opening 26 shown in FIG. 4. The now ring shaped lid parts or lid rings, respectively, are then conveyed into a working station wherein a foil 25 is placed over the opening of the lid or lid ring, respectively, and is fixed to the surface thereof by heat sealing, as can by seen in FIGS. 5 and 6. The underside of the metal foil is provided to this end with a coating of a plastic layer suitable for heat-sealing, as known to the man skilled in the art. The foil cut 25 that is needed is usually punched out within the heat sealing station from a broad sheet of foil and placed over the middle opening of the annular disk and in the heat sealing station the foil is pressed to the edge of the round opening of part 20 and heat is used, so that the foil 25 is fixed and sealed to the lid ring 20 by melting and then cooling down of the plastic layer. To this end upper and lower sealing heads are provided. This is known to the person skilled in the art and is not explained here in greater detail. A cooling station may be provided for faster cooling down the heat seal between lid ring and foil. In a further working station an embossing step will provide an embossment 24 (FIG. 7) to the foil 25 and the edge 22 will usually be beaded further to form the finished edge 23. An inspection step follows as indicated by the eye in FIG. 8. This step may include a test of the tightness of the heat sealing connection of the lid ring and the tear-off foil.

The demands that must be met by such tear-off container lids are of course the same that must be met by conventional container lids for metal containers or other containers. One of the demands is resistance to corrosion. Corrosion resistance is necessary on the one hand against outside influences on the container and its lid, but on the other hand against the influences of the goods within the container, which may be chemically aggressive. Corrosion is an issue in particular with regard to humid or liquid goods and in view of the long shelf life that is required of such packages. The metal sheets for manufacturing the lids or lid rings, respectively, are coated metal sheets to prevent corrosion. Such coatings are known to the man skilled in the art and comprise for example a coating of polyethylene terephthalate (PET) or a coating of a highly resistant lacquer on the inside of the container, which coatings are suitable for beading steps without chipping and flaking during such steps and resist even aggressive goods over the required shelf live that may be in the range of several years. The outside of the lid or lid ring, respectively, is coated with polypropylene (PP) or with a lacquer containing polypropylene particles, despite the fact that such a coating has only limited properties for beading (which means that the resistance to stress of such coatings is low) since polypropylene is the preferred material for the heat sealing of the tear-off foil which can be sealed with the necessary quality only on a polypropylene coating. The PET coating as well as the PP coating have proved their worth in the industrial field.

The cut edge that results from punching the lid opening 26 has no coating anymore. Such an uncoated edge may be acceptable for dry goods and a short shelf life; in most cases, however, corrosion results which impairs the quality of the goods and which may for example impair the taste of edible goods. To solve this problem it is known to bead the edge of the cut in the form of a so called retort-curl. By this beading the bare cut edge is concealed by a surface portion of the lid ring and is in most cases not accessible by the goods. A disadvantage of this known solution can be seen in the rather high manufacturing costs, mainly caused by the tools. But the most relevant disadvantage is the fact that manufacturing a retort-curl in mass production with the necessary high quality and in reproducible quality is hardly possible. The slightest irregularities in the manufacturing process may lead to abnormal shapes of the retort-curl and thus causing an insufficient concealment of the cut edge. Even a slight change of the width of the rolled in wall section results therein that the cut edge does not abut consistently on the corresponding surface area of the lid ring so that the goods can reach the bare edge.

WO 01/07330 shows a solution wherein the lid ring is punched from uncoated metal blank material. By this solution it is possible to easily recycle the stamped out round middle metal blank part which is not coated as well, which lowers the cost of material for the lid rings produced in this way. The following coating of the formed lid ring must be made as a powder coating since the usual coating procedures suitable for metal blanks can not be used. The teaching of this document leads thus to a coated cut edge; but a disadvantage is that the powder coating of a geometrically complicated shaped body, for example of a lid ring, is difficult and is therefore not fully suitable for industrial mass production. WO 2006/092073 teaches to cover the cut edge separately with a hot-melt material. EP-A-0 090 957 teaches to bend the border of the lid opening towards the outside of the lid which places the cut edge outside of the container cavity containing the goods. But this impedes the application of the tear-off foil.

SUMMARY OF THE INVENTION

It is an object of the invention to avoid the mentioned disadvantages of containers with tear-off lids and of tear-off lids, respectively. It is a particular object to provide a container with a tear-off lid free of corrosion problems of the cut edge of the take out opening.

This object is met by a container with a tear-off lid wherein the cut edge of the take out opening of the lid is arranged within the connection area of the lid to the container body.

Since the cut edge of the lid opening is placed into the connection or fixation area, respectively, of the lid to the container body it is not exposed anymore to the goods within the container. The cut edge is enclosed between the coated container body and the coated lid. Thus the cut edge is secured against corrosion in a manner that allows simple and reproducible manufacturing of the lids with a corrosion protection of the cut edge. The bending back of the cut edge so far that it reaches the connection area thus solves the problem of corrosion.

The tear-off lid is secured to the container body preferably by seaming or hemming, respectively. It is then preferred that the cut edge lies close to or contacts the non folded part of the inside of the container body. This allows the production of the seam or hem, respectively on conventional machines for the production of the seaming/hemming. In another embodiment the cut edge may be placed within the seaming or hemming area, respectively, so that the cut edge is arranged within the folded area; this still allows the production on conventional machines or on only slightly modified machines for making the seam. It is preferred that the cut edge is covered in the connection area by a material which is preferably the sealing material of the hem. Preferably the bending radius at the lid take out opening for leading the cut edge back is greater than or equal to 1 millimeter. This avoids a flaking off of the plastic coating of the lid ring.

Another object of the invention is to provide a tear-off lid and a tear-off lid ring for the container according to the invention.

This object is met by a tear-off lid and a tear-off lid ring, respectively, for a container wherein the cut edge of the take out opening of said lid is led back to the chuck wall of said lid By leading the cut edge into the area of the chuck wall the same advantages result for the lid or lid ring, respectively, as has been explained above for the container.

Another object is to provide a manufacturing method for a container with a tear-off lid and this object is met by a method for making a container with a tear-off lid of coated metal sheet material wherein said tear-off lid is provided with the take out opening by bending back the cut edge of said take out opening to provide a flange arranged for heat sealing said tear-off foil of double thickness of said metal sheet material and by leading said cut edge back to the chuck wall and by connecting said tear-off lid to the body of said container by a seaming or hemming connection, respectively, and wherein said cut edge is arranged between said chuck wall of said lid and the inner container body wall.

BRIEF DESCRIPTION OF THE DRAWINGS

Further embodiments, advantages and uses of the invention follow from the dependent claims and from the following description and the drawings, wherein:

DESCRIPTION OF THE PREFERRED EMBODIMENTS

Figure 1:
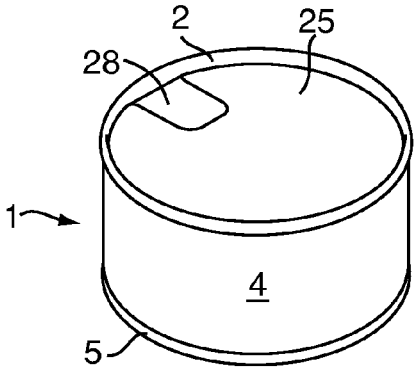
FIG. 1 Prior Art
FIG. 1 is a perspective view of a container with a tear-off lid.

The proportions shown in the Figures are to be understood as examples only and shall not be understood as limiting the invention. Same reference numerals in the Figures depict elements that are structural and functional equivalents. The geometry of the packages or containers, respectively, and thus of the corresponding lids is not limited to round shapes. Oval shapes, rectangular shapes or other shapes are included as well. In preceding and following description and claims such shapes are included in the terms "container", "tear-off lid" and "tear-off lid ring". The term "tear-off lid ring" shall mean a carrier for a sealed foil. The container body may consist of metal as well but may consist of another material and in particular of a material including cardboard or may consist of a laminated material, such as a material with cardboard and aluminium layers.

FIG. 1 shows a container 1 with a container body 4 and with a tear-off lid 2 which lid opening provided by a lid ring is closed by a tear-off foil 25. This foil 25 is provided with a flap 28 for tearing off the foil from the lid ring. In the view of FIG. 1 no difference can be seen between a prior art container and a container according to the present invention. FIGS. 2 to 8 show the prior art steps for making the tear-off lid as explained before which is as well the preferred method for manufacturing the tear-off lid ring and the tear-off lid for the present invention with the exception of the protection of the cut edge 21 according to the invention. The cut edge will be depicted by the reference numeral 3 in the embodiments of the present invention. With this exception in mind reference is made to the above description of the prior art steps for making the lid. The container is further provided with a base cover 5 which may be in particular a metal cover 5 fixed to the body 4 by hemming.

Figure 9:
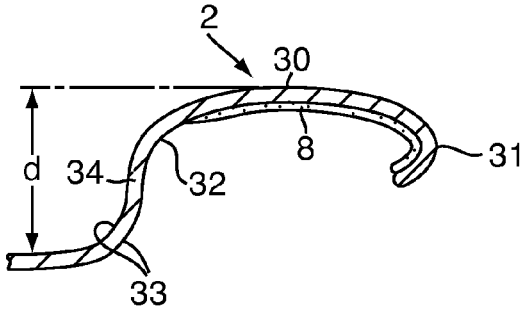
FIG. 9 Prior Art
FIG. 9 shows a view of the outer border of the lid before seaming.
Figure 10:
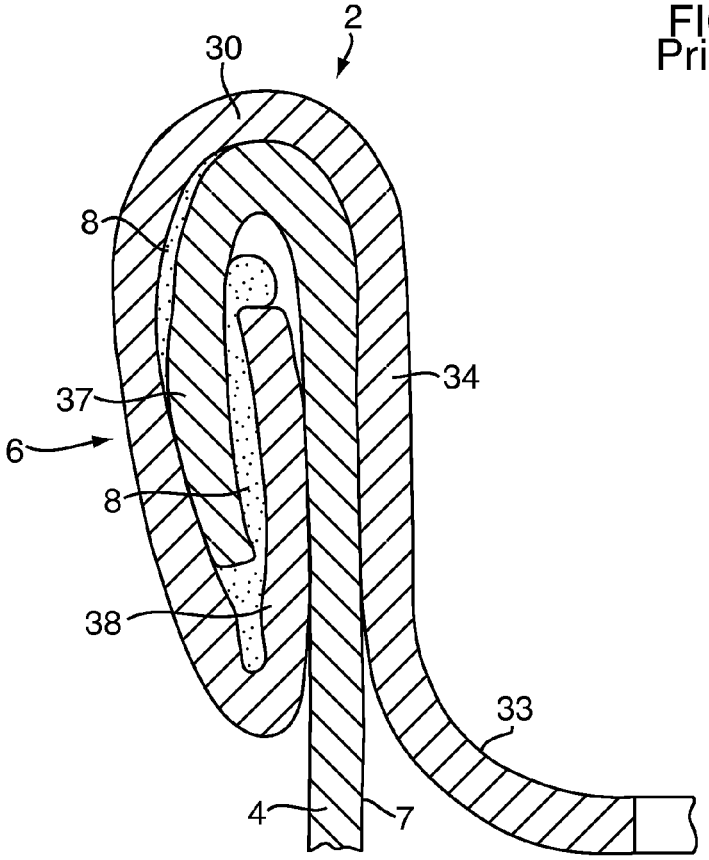
FIG. 10 Prior Art
FIG. 10 shows a view of the seaming or hemming connection of lid and container body.
Figure 3:
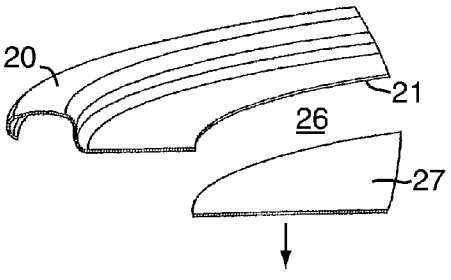
FIG. 3 Prior Art
FIGS. 2 to 8 show sectors of metal lids for the explanation of prior art lid manufacture.
Figure 4:
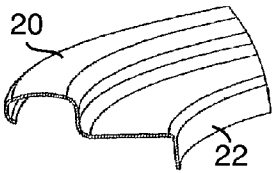
FIG. 4 Prior Art
Figure 2:
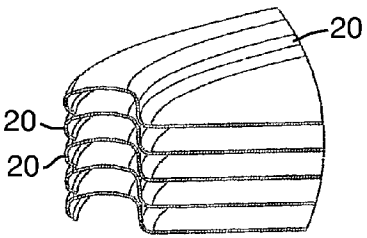
FIG. 2 Prior Art
Figure 7:
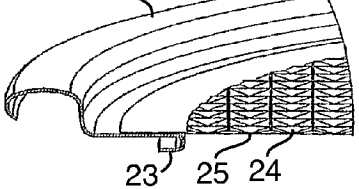
FIG. 7 Prior Art
Figure 6:
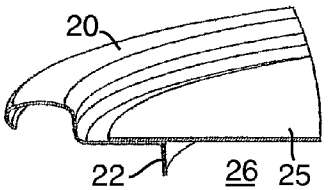
FIG. 6 Prior Art
Figure 5:
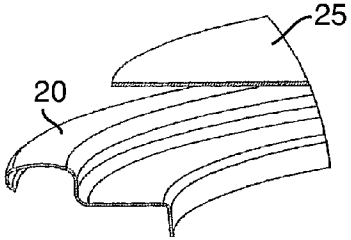
FIG. 5 Prior Art
Figure 8:
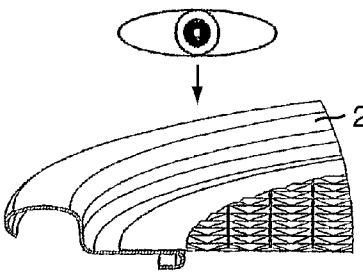
FIG. 8 Prior Art

The fixation of the tear-off lid 2 at the container body may be effected by any known method and means as long as they are compatible with the protection of the cut edge as explained below. Preferred is a fixation of the lid to the body by beading, seaming or hemming, respectively. FIG. 9 shows the border of the lid for the connection by seaming/hemming and FIG. 10 shows the corresponding fixation by folding or hemming, respectively, as known to the man skilled in the art.

FIG. 9 shows only a part of the lid ring 2 in sectional view. This embodiment of the lid comprises (as in FIGS. 2 to 8) a seaming panel 30 which is provided at the outside of the lid with a curl 31. On the inside of the seaming panel 30 a sealing compound 8 may be provided. Towards the take out opening of the lid, which is not shown in FIG. 9, the lid ring 2 is provided with seaming panel radius 32 by which the seaming panel changes into the so called chuck wall 34 which is followed by the chuck wall radius 33. The mentioned radii together with the chuck wall 34 size result in the countersink depth d. When such a lid is connected by seaming or hemming, respectively, with a container body having a flange on its lid side edge the connection according to FIG. 10 will be provided which is prior art known to the man skilled in the art. The seaming or hemming is done as known to the man skilled in the art by a seaming/hemming head that engages the lid and by different V-shaped rollers that effect the seaming/hemming steps one after the other from the outside. The finished connection according to FIG. 10, wherein same reference numerals depict same elements as in FIG. 9, is provided in that a folded body hook 37 of the container body engages the endhook 38 of the lid. Thereby a stable connection between lid 2 and body 4 results, wherein the chuck wall 34 can lie against the inner wall 7 of the body. The mentioned sealing or lining compound 8, respectively, seals the hemming connection. This connection thus defines a connection zone or area 6 where lid and body are connected to each other.

Figure 11:
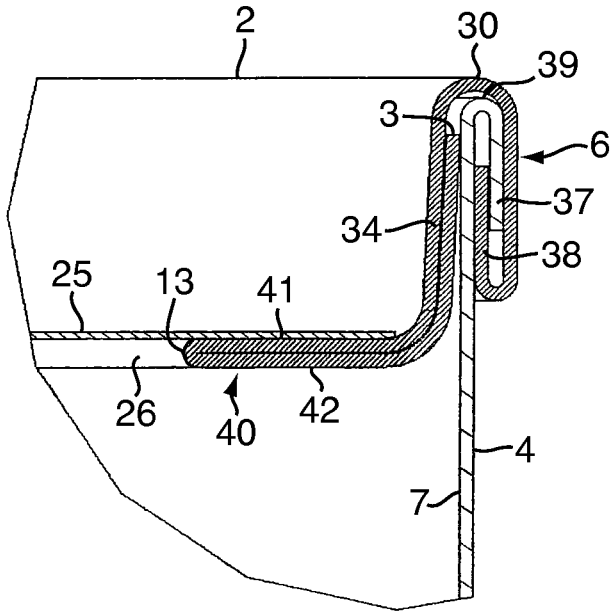
FIG. 11 shows a view of an embodiment of the invention.

Now, FIG. 11 shows a preferred embodiment of the container 1 and tear-off lid 2 and tear-off lid ring, respectively, according to the invention. Again, only a part of the container and lid is shown. As can be seen, and differently from the lid 20 of prior art FIGS. 2 to 8, the cut edge 3 (formerly 21 in prior art FIG. 3) of the lid 2 is led back into the connection zone or area 6 of the lid 2 to the container body 4. This is shown for the preferred connection of body and lid by seaming or hemming, respectively. The connection of lid 2 and body 4 could be made in different ways mechanically by positive locking of these elements and/or by frictional connection or by an adhesive or heat-sealing or by any combination of such connection methods and means. What is essential is that the cut edge 3 is led back from the take out opening 26 of the lid ring into the connection zone 6 of lid and body so that the cut edge is fully enclosed by the lid itself and the inner sidewall 7 of the body, so that it is protected against the influence of the goods in the container. The enclosure of the bare edge 3 can be enhanced by a sealing compound and/or an adhesive or glue, respectively, and/or by a heat-sealable compound. But primarily the protection is given by the bending back into the connection area 6 of lid and body. FIG. 11 shows an enlarged view. For a diameter of the lid of approx. 50 millimeters the length of the bent back part from the lid opening 26 to the connection area or seaming or hemming area 6, respectively, amounts for example about 7.8 millimeters. Such dimensions are of course only an example. It can be seen that in this preferred embodiment the cut edge 3 lies with one of its borders on the inside 7 of the body and is contacted on its other border by the chuck wall 34 of the lid so that a complete enclosure and thus protection of the edge 3 is provided. In this embodiment the edge 3 is led back into the connection area 6 but is not led back so far that it would be brought into the proper hemming or seaming connection of lid and body. In another embodiment not shown in the drawing the cut edge 3 could be brought back so far that is reaches into or over the curvature of the seaming panel 30 so that the cut edge is included into the seaming or hemming and reaches over radius 39 of the container body flange depicted in FIG. 11. It is preferred that the sealing compound 8 not shown in FIG. 11 is provided in such a manner that it reaches the cut edge 3 and covers and protects this edge as well.

Adjacent to the take out opening 26 and directly adjacent to the bent edge 13 a flange 40 is thus provided that is formed by the sheet material sections 41 and 42 of the lid 2 and has the double thickness of the metal sheet of the lid. This lid construction which results from the leading back of the cut edge into the connection area 6 is advantageous for the heat sealing of the tear-off foil 25, and in particular if the heating is effected by induction heating, since more thermal energy can be brought into the double flange 40. Since a polypropylene coating is present on the underside of flange 40 caused by the leading back of the cut edge this has to be considered for the design of the lower sealing head, for example by providing this head with a coating preventing the sticking of the heat sealable polypropylene coating.

Figure 12:
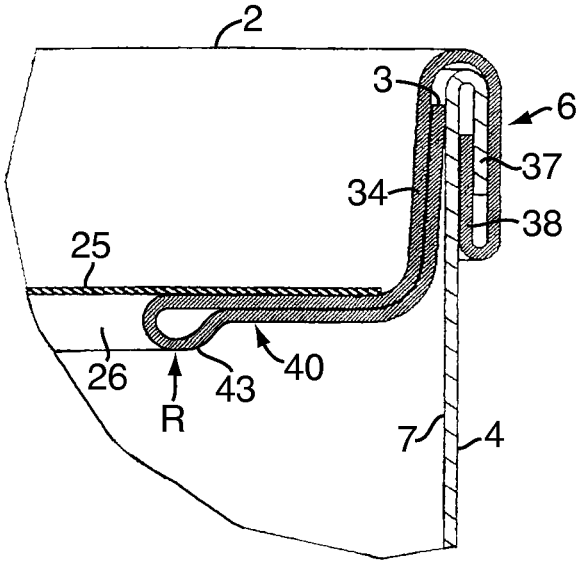
FIG. 12 shows another embodiment of the invention.

FIG. 12 shows another embodiment wherein the bend 43 on the border of the take out opening 26 is made with a radius R which is preferably greater than approximately 1 millimeter. Such a radius prevents chipping or flaking of the polypropylene coating at the bend.

Thus according to one aspect of the invention a container 1 is provided with a tear-off lid 2 having a take out opening covered by a tear-off foil 25. The cut edge 3 of the take out opening is bent back into the chuck wall 34 area. By this the bare cut edge is protected by the connection of lid and container body. This connection can be provided by a seaming connection.

While there are shown and described presently preferred embodiments of the invention, it is to be distinctly understood that the invention is not limited thereto but may be otherwise variously embodied and practiced within the scope of the following claims.

The invention claimed is:

1. A container with a container body and a tear-off lid, wherein the lid and the container body are connected to each other by seaming and a cut edge of a take out opening of the lid is bent back and arranged within an area of the seaming connection of the lid to the container body, and wherein the cut edge contacts an inside of a wall of the container body and a chuck wall of the lid.

2. The container according to claim 1 wherein the cut edge contacts an inside of the container body.

3. The container according to claim 1 wherein the cut edge is arranged within the seaming connection between the lid and the container body.

4. The container according to claim 1 wherein the cut edge is covered by a sealing compound.

5. The container according to claim 4 wherein said sealing compound is the sealing compound within said seaming connection between said lid and said container body.

6. The container according to claim 1 wherein a bending radius at the edge of said take out opening is equal to or greater than 1 millimeter.

7. The container according to claim 1, further comprising a lid ring, wherein the lid ring is made of metal coated with a plastic material.

8. A tear-off lid ring for a tear-off lid wherein a cut edge of a take out opening of said lid ring is bent back to a position located radially outward of a chuck wall of said lid ring.

9. A tear-off lid for a container, wherein said tear-off lid is provided by a lid ring made of metal sheet material and having a central take out opening covered by a tear-off foil, and wherein a cut edge of said take out opening of said lid is led back by bending of said metal sheet material to a position located radially outward of a chuck wall of said tear-off lid.

10. The tear-off lid according to claim 9 wherein a bending radius at a bent edge of the take out opening is equal to or greater than 1 millimeter.

11. A method for making a container with the tear-off lid of claim 9, wherein said tear-off lid is provided with the take out opening by bending back the cut edge of said take out opening to provide a flange of double thickness of said metal sheet material, by leading said cut edge back to the chuck wall, and by connecting said tear-off lid to the body of said container by a seaming connection, and wherein said cut edge is arranged between said chuck wall and the inner container body wall.

12. Method according to claim 11 wherein a sealing compound is provided in the seaming connection of said lid to said body and said sealing compound is provided for covering said cut edge.

* * * * *